United States Patent [19]

Ricciardi

[11] Patent Number: 4,516,761

[45] Date of Patent: May 14, 1985

[54] MOTOR DRIVEN CONTINUOUS FORM FOLDER

[75] Inventor: Mario Ricciardi, Glenview, Ill.

[73] Assignee: Bell & Howell Company, Chicago, Ill.

[21] Appl. No.: 602,990

[22] Filed: Apr. 23, 1984

[51] Int. Cl.[3] ..... B41L 43/04

[52] U.S. Cl. ..... 270/41; 493/446; 226/195

[58] Field of Search ..... 270/40–41; 493/405, 416, 439, 446–447, 454; 226/104, 195

[56] References Cited

U.S. PATENT DOCUMENTS

| | | | |
|---|---|---|---|
| 2,868,539 | 1/1959 | Koons et al. | 270/41 |
| 2,908,494 | 10/1959 | Brodie | 270/41 |
| 3,125,335 | 3/1964 | Becker | 270/5 |
| 3,807,724 | 4/1974 | Bartz | 493/416 |
| 4,285,686 | 8/1981 | Ambler | 493/439 |

*Primary Examiner*—E. H. Eickholt

*Attorney, Agent, or Firm*—Neal C. Johnson; Alan H. Haggard; Alan B. Samlan

[57] ABSTRACT

A web folding device is disclosed for use in combination with a web processing machine which draws the web from the web folding device in a downstream path of travel, the device comprising:

a frame;

an upper roller mounted to the frame and extending horizontally across the path of travel of the unfolded web;

a motor driven roller mounted to the frame below the upper roller and extending horizontally across the path of travel of the folded web;

a pair of fold plates mounted to the frame and disposed between the upper roller and motor driven roller, the fold plates defining a channel through which the web passes and is folded by the fold plates contacting the surface of the web on opposite sides of the fold line;

a driven exit roller mounted to the frame and positioned downstream from the motor driven roller;

at least one drive belt connecting the motor driven roller to the driven exit roller, such that both rollers rotate in the same downstream direction;

whereby when the web processing machine is not drawing the web from the device the web is slack and does not tightly engage the drive belt such that the web is not driven in the downstream direction of travel, and when the web processing machine is drawing the web from the device the web is placed in tension and frictionally engages the drive belt such that the belt aids in driving the web in the downstream direction of travel.

12 Claims, 6 Drawing Figures

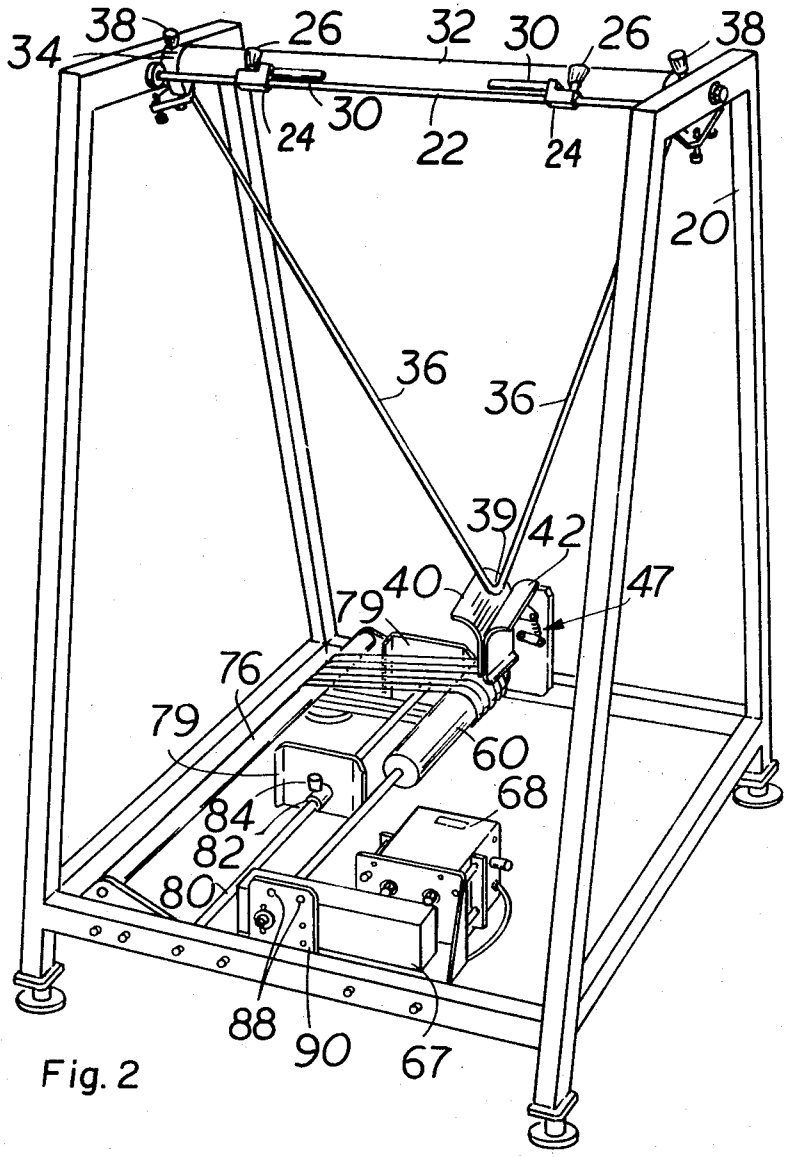
Fig. 2
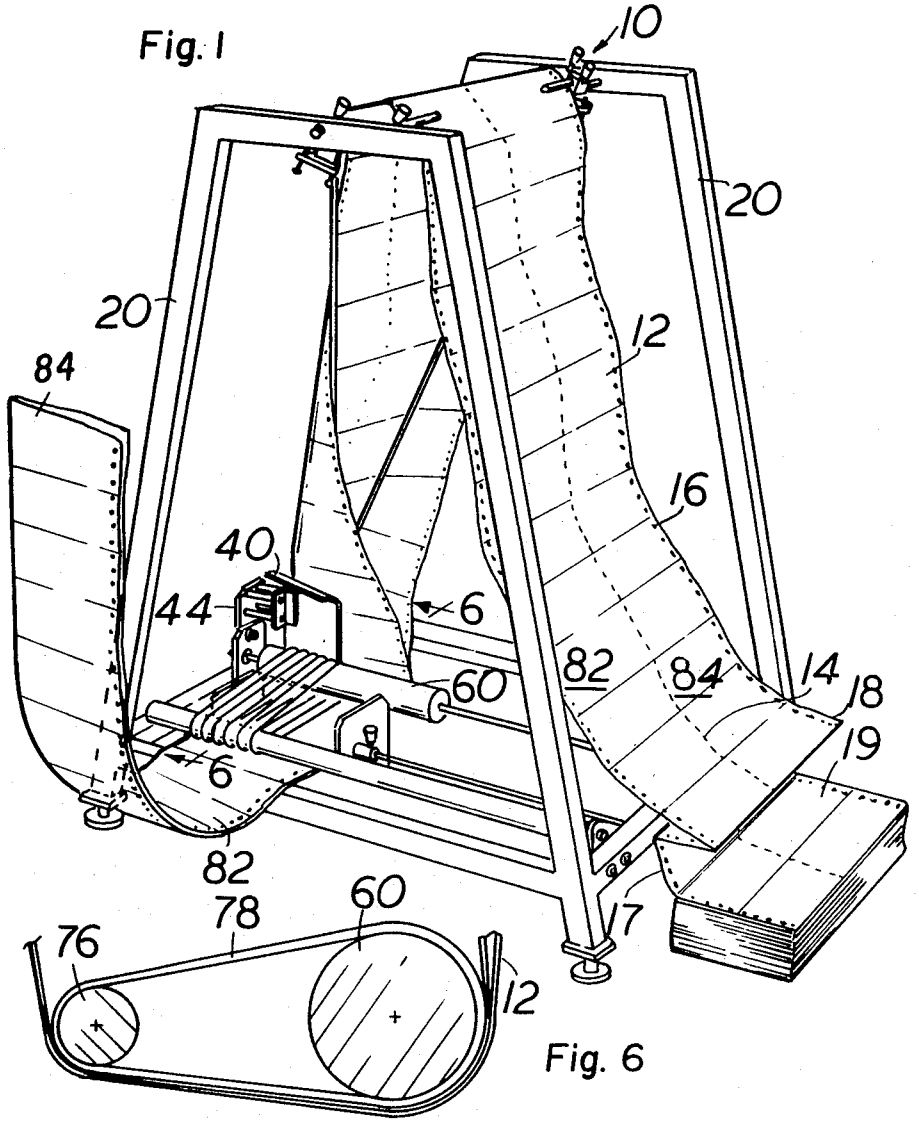
Fig. 1
Fig. 6

MOTOR DRIVEN CONTINUOUS FORM FOLDER

BACKGROUND OF THE INVENTION

This invention relates to a folding device and particularly to a device which folds a web of continuous paper along a weakened perforation or fold line which extends longitudinally along the web. The web folding device is used in combination with a web processing machine which draws the web from the web folding device in a downstream path of travel. There are many types of business correspondence which are prepared by computer and generated by means of a continuous form. The continuous form is folded along a longitudinal weakened fold line prior to being either burst apart or cut such that the individual pieces of correspondence can be inserted in an envelope for mailing. Typical examples of such applications are insurance premium notices, mortgage payment notices, and other payment forms. With this type of correspondence, it is intended that the recipient keep one part of the form, separate and return the other part to the sender. The continuous web is provided with a longitudinal fold line or perforation line which is generally the fold line for the form.

Several prior devices have attempted to fold the continuous web along the longitudinal weakened fold line. One example is illustrated in U.S. Pat. No. 4,395,255 issued July 26, 1983 to Branecky, et al. This device provides the folding a web along a longitudinal fold line by drawing the web over a drag member longitudinally extending across the path of travel of the unfolded web. The web then passes around several rollers and exits from the folding device. However, this device still tends to cause the web to tear along the horizontal perforations as it is drawn through the web folding device. Furthermore, this device does not provide for feeding the web from either side of the device and can fold the web in only one way with the web on one side of the fold line always being folded on top of the other side of the web. Branecky attempts to compensate for the possibility of tearing the web by mounting one of the lower rollers transverse to the drag member at an angle of approximately 95° with respect to a vertical plane passing through the drag member. However, even with this angular mounting, the entire force of pulling the web through the web folding apparatus must be applied to the web itself. Therefore, the web and the perforations must have sufficient strength to allow the web to be drawn through the web folding apparatus without tearing and yet still be perforated in such a manner that it can be easily burst by the bursting machine.

Another prior art device is illustrated in U.S. Pat. No. 3,356,557 issued Dec. 5, 1967 to Enskat. In this device a web of paper is fed from a first roller to a second roller which is oriented at right angles to the first roller and spaced above it. The web is folded while it is traveling between the rollers. There is not any means to aid or guide the web as it is folded. Furthermore, there are not any provisions for aiding or guiding the web as it is folded. There are not any means to alleviate or minimize the forces on the web to reduce the possibility of the web inadvertently tearing as it is being folded or passing through the web folding device.

None of the devices shown in the prior art illustrate or suggest a web folding device which can be adapted to fold a web along a fold line such that either side of the web along the fold line can be folded over the other side. Thus, none of these prior art devices can provide for either portion to become the top portion after the web is folded. This presents an obvious shortcoming and limitation in prior devices. If addresses or other information must be placed in a predetermined orientation after folding, the continuous web must be preprinted in a certain way. If the web can be folded with the web on either side of the fold line oriented on top, the user has greater latitude and options in generating and working with the web.

Accordingly, an object of this invention is to provide an improved web folding apparatus for folding an unfolded web longitudinally along a weakened fold line, the web folding device designed for use in combination with a web processing machine which draws the web from the web folding device.

Another object is to provide a web folding device which alleviates some of the stresses on the web as it is folded to minimize the possibility of the web inadvertently tearing. A related object is to provide an improved web folding device which aids in feeding the web in a downstream path of travel as it is being folded.

Yet another object is to provide a web folding device which aids in feeding the web as it is being folded by means of a motor-driven roller which causes a belt to contact and drive the web only when the web processing machine is drawing the web.

Still another object is to provide a web folding device which can accommodate receiving the web from either of two sides of the device such that either side of the web adjacent the longitudinal weakened fold line can become the top surface of the web after it is folded.

SUMMARY OF THE INVENTION

According to the specific embodiment illustrated in the drawings herein and discussed in detail below, a web folding device is positioned upstream of a web processing machine. The web processing machine is generally a burster/folder or cutter having means to draw the web through the web folding device and into the web processing machine. A stack of continuous form paper is placed adjacent one side of the web folding device and the unfolded web is placed around an upper roller mounted to the frame of the device. The upper roller extends horizontally across the path of travel of the unfolded web. The web then passes over guide bars which guide the web between a pair of fold plates. The web is gradually folded between the fold plates with the fold plates contacting the surface of the web on opposite sides of the fold line. The gradually folded web passes around a motor-driven roller which is continuously driven. At least one and preferably a plurality of drive belts pass around the motor-driven roller and couple it to an exit roller such that both rollers rotate in the same downstream direction. The folded web exits past the driven exit roller and proceeds downstream to the web processing machine. When the web processing machine draws the web, the web is placed in frictional engagement with the belts passing around the motor-driven roller and the driven exit roller. The frictional engagement causes the web to be driven in the downstream direction. When the web processing machine is not drawing the web from the device, the web is slack and does not engage the drive belt. Thus, the web is not driven in the downstream of travel. The motor-driven roller has at least two different diameter portions which provide for a greater force being exerted on the web along the fold line and a lesser force along the edges, which minimizes the risk of the web tearing. One of the fold plates is preferably spring loaded to maintain a slight compressive force against the web as it passes between the fold plates and is gradually folded.

The web folding device is also adapted for reversing the position of the motor driven roller and fold plates. The web can thus be fed from either side of the device. This results in the web on either side of the fold line being capable of being folded over the other portion and exiting the device as the top piece of the folded form.

BRIEF DESCRIPTION OF THE DRAWINGS

FIG. 1 is a perspective view of the web folding device showing the path of travel of the unfolded and folded web.

FIG. 2 is a perspective view of the inventive device taken from a different angle than the perspective of FIG. 1.

FIG. 6 is an enlarged fragmentary view taken along lines 6—6 of FIG. 1 showing the drive belt coupling the motor-driven roller to the driven exit roller.

DESCRIPTION OF THE PREFERRED EMBODIMENT

Figure 3:
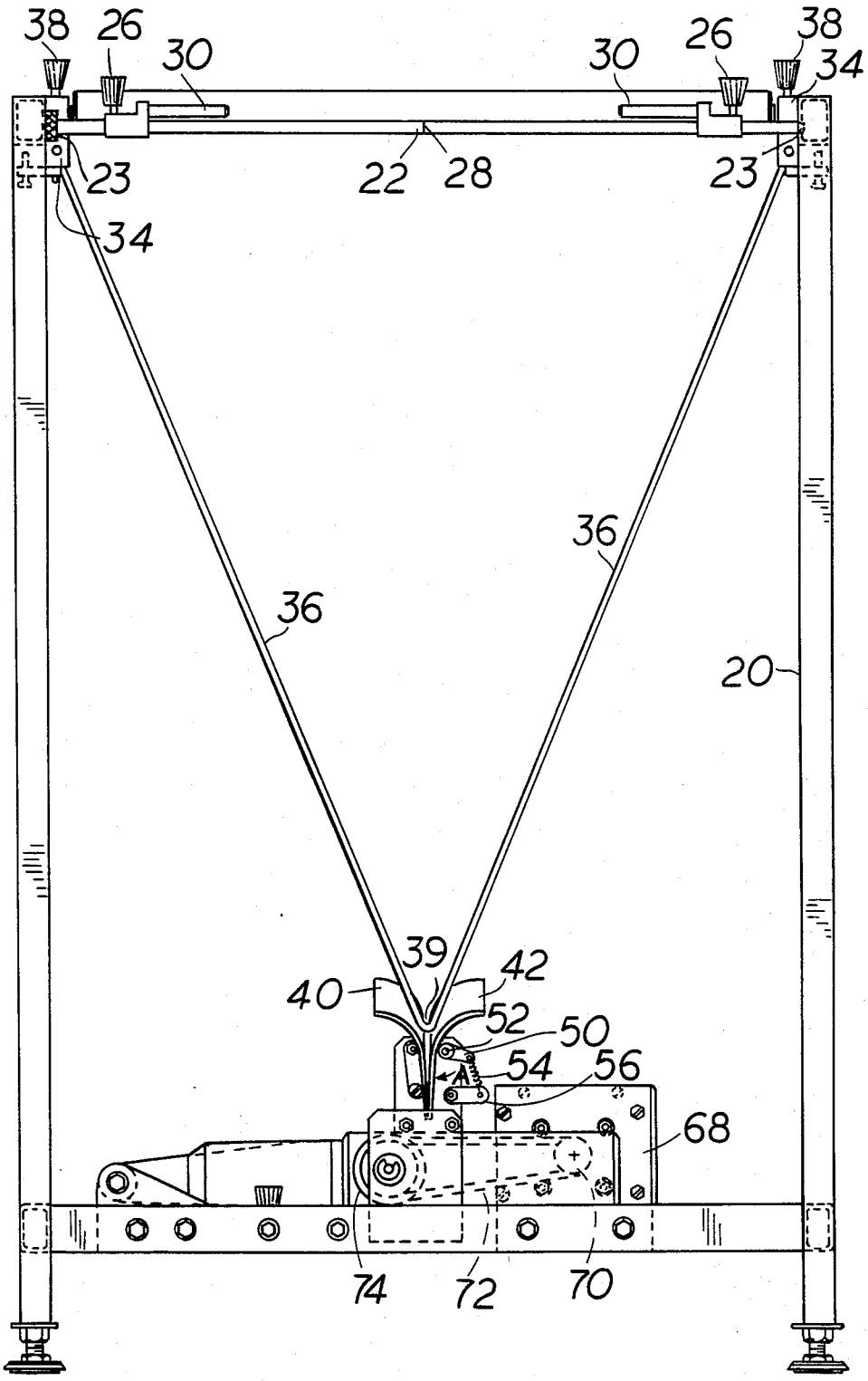
FIG. 3 is an end view of the web folding device.

Turning first to FIG. 1, there is illustrated a web folding device 10 of the present invention. The device 10 is designed to fold a web of paper 12 along a weakened fold line 14. The fold line 14 can be formed by a perforation or score line which is longitudinally positioned along the web. The web 12 can also have pin feed holes 16 along the opposite edges 17, 18. A web processing machine (not illustrated) positioned downstream along the path of travel of the web draws the web through the device 10 by means of the pin feed holes 16 or feed rollers. The unfolded web 12 is accordian folded and placed in a stack 19 which is placed on the floor at one side of the device 10. A frame 20 is used to support the various components.

The operation of the device 10 can best be described by following the web 12 as it is folded. The web 12 first passes over a rod 22 which is at the top of the device 10. The rod 22 is removably mounted in holes 23 in the frame 20. At opposite sides of the rod 22 are collars 24 which can be slid along the rod 22 by means of thumb screws or set screws 26. The collars 24 are adjusted such that the web will have a slight clearance between the opposite collars 24. An alignment marking 28 is placed on the rod 22 as will be more fully described herein. Each collar 24 has guides 30 which extend parallel to rod 22 and in a spaced relationship thereto. As seen in FIG. 1, the web 12 passes between the rod 22 and the guides 30.

The web 12 then passes over a free rolling idler roller 32 which is mounted in bearing supports 34 at either end of the roller 32. The bearing supports are mounted to the frame 20.

Also mounted to bearing supports 34 are a pair of guide bars 36 which guide and direct the web in a downward path from the idler roller 32. By means of thumb screws 38 in the bearing supports 34, the downward angle of the guide bars 36 can be adjusted. An apex 39 formed where the guide bars 36 come together, is in the same vertical plane as a plane passing perpendicular through the rod 22 and through the alignment marking 28. Thus, the apex 39 is in vertical alignment with the alignment marking 28. As seen in FIG. 3, the apex 39 is also in alignment with the center of a chute formed between a fixed folding plate 40 and a pivotal folding plate 42.

Figure 5:
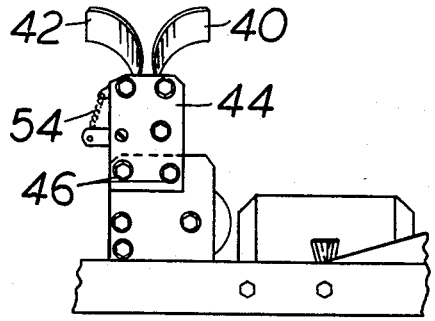
FIG. 5 is a fragmentary view illustrating the pair of fold plates.

The web begins to be folded about the guides 36 and continues to be gradually folded as it passes between the folding plates 40 and 42. The folding plates contact the surface of the web on opposite sides of the fold line 14. The fixed folding plate 42 is mounted to the frame 20 by means of a fold plate mounting support 44 which can best be seen in FIGS. 1, 4 and 5. The mounting support 44 is fastened to the frame 20 by means of fasteners or screws 46.

Figure 4:
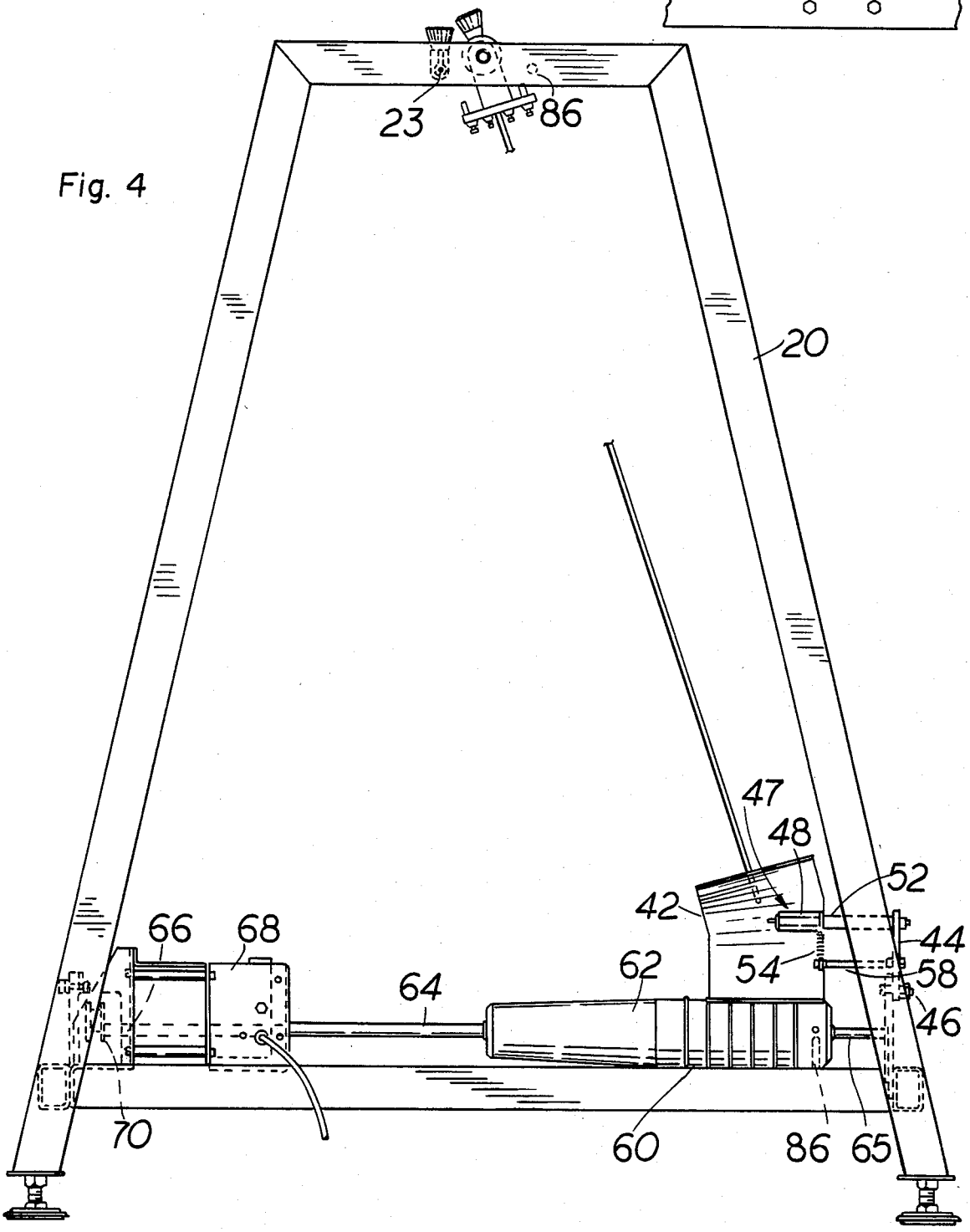
FIG. 4 is a side view of the web folding device with portions removed.

The pivotal plate 42 is connected to the support 44 by a pivoting mechanism 47, which will now be described. As seen in FIG. 4, a bracket 48 having an integrally formed link 50 is attached to the plate 42. The bracket 48 and link 50 are rotatably mounted on a support rod 52 which is fastened to the support 44. The support rod 52 functions as a pivot for the bracket 48 and link 50. A tension spring 54 has one end attached to the link 50 and the other end is attached to a stationary link 56 which is affixed to mounting bracket 44 by means of support rod 58. The folding plate 42 thus tends to rotate about the support rod 52 in the direction of arrow A (FIG. 3). In this manner, the pivotal folding plate 42 can maintain a slight pressure against the face of the web 12 as it is folded between the fixed and pivotal folding plates 40 and 42. The fold plates 40 and 42 and the pivoting mechanism 47 are fastened to the frame 20 by means of the screws 46.

After the web is gradually folded between the fold plates 40 and 42, it makes a right angle change of direction from a substantially vertical downward path to a horizontal path traveling at 90 degrees with respect to the original downward path. As seen in FIGS. 1 and 6, the folded web 12 passes around a drive roller 60. As seen in FIG. 4, the drive roller 60 has a tapered portion 62 which is the portion of the roller furthest from the folding plates 40, 42. The drive roller 60 is mounted on a drive shaft 64 which has one end 65 mounted in the frame 20 and the other end 66 mounted in a power transmission box 67. Power is supplied by means of a motor 68 and a drive pulley 70 which has a toothed belt 72 passing around it and a second driven pulley 74. The driven pulley 74, in turn, is connected to the end 66 of the drive shaft 64 which causes the drive roller 60 to rotate.

A second roller or driven roller 76, is also mounted to the frame 20 parallel to the drive shaft 64. The driven roller 76 is connected or coupled to the drive roller 60 by means of a plurality of belts or "O" rings 78. A series of circular grooves (not numbered) are cut into the outer surface of the drive roller 60 to keep the belts 78 in the proper position.

There are also placed a pair of paper guides 79 along a rod 80 as seen in FIGS. 1 and 2. The paper guides 79 are mounted on an adjustable collar 82 which is adjusted by thumb screws 84 to the width of the folded web.

To initially set up the web 12 for folding, the fold line or perforation 14 is aligned with the alignment marking 28 on the rod 22. The guides 30 are then adjusted to clear the edges 17 and 18. This ensures that the fold line 14 will be directed into the chute formed between the fold plates 40 and 42.

The web processing device located downstream (not illustrated) which is used in conjunction with the web folding device 10 will draw the web upward (as seen in FIG. 1) from the driven roller 76 at the exit of the device 10. The drawing of the web 12 is generally accomplished by a demand feeder which can be a tractor pin feeder engaging the pin feed holes 16 on the web 14. Regardless of the type of web processing device used, the web processing device will always draw the web from the exit of the folding device 10 in a generally upward direction. During the demand feed, tension is applied to the web 12. This causes the web 12 to frictionally engage the belts or "O" rings 78 which are wrapped around the drive roller 60 and driven roller 76. The frictional engagement between the "O" rings 78 and the web 12 causes the web to be driven in the downstream direction of travel. Thus, the "O" rings 78 assist in driving the web 12 in the downstream direction and the web is not relying solely upon the take-up force of the web processing device located downstream. When the demand feed of the web processing device is not activated, the web 12 is slack and the web 12 does not engage the "O" rings 78 with sufficient frictional force to cause the web to be driven in the downstream direction. Rather, the web 12 loosely brushes the "O" rings 78 which are continuously driven by the drive roller 60.

The motor 68 and the drive mechanism used to rotate the drive shaft 64 are designed so that the linear velocity of the "O" rings 78 as they pass around the drive roller 60 is greater than the speed with which the demand feeder on the web processing device draws the web 12. The reason is that the "O" rings 78 would cause a negative drag force on the web 12 if the linear velocity was not greater than the speed of the demand feeder.

It can be seen in FIG. 1 that the edges 17 and 18 of the web 12 will be adjacent to the tapered portion 62 of the drive roller 60 as it is folded around it. The fold line 14 is adjacent the thicker portion of the drive roller 60. This design helps to minimize the possibility of the web tearing along either the weakened fold line or perforation line 14, or any horizontal perforation lines. The demand feeder in the web processing device pulls the web with uniform tension across the web. By providing the tapered portion 62, a "relief" is provided which tends to lessen the forces on the web 12 at its edges 17 and 18 where the web is most likely to tear. The greater pulling force on the web 12 is along the fold line 14 which is the stronger portion of the web and therefore less likely to tear.

As seen in FIG. 1, the portion of the web 12 on the left side of the fold line 14 (designated as 82) becomes the top of the folded form as it exists the web folding device 10. Appliant's invention provides for folding the web so that the portion of the web on the right side of the fold line in FIG. 1 (designated as 84) can be the top of the folded form at the exit. This is unique in folding devices as previously no device was available which could be easily adapted for feeding the web from either side of the device with the result that either side of the web 82 or 84 can exit as the top portion of the folded form.

To accomplish this, applicant's device 10 provides for feeding the web 12 from the side opposite that shown in FIG. 1. Only a few adjustments are required. The rod 22 is removed from the holes 23 which mount it to the frame 20 and is placed in complementary holes 86 in the frame on the opposite side of the idler roller 32. Screws 46 are removed and the fold plate mounting bracket 44 is moved from one side of the frame and fastened to receiving holes 88 in bracket 90 on the other side of the frame. Thus, the folding plates are now reversed and placed on the opposite side of the frame. Similarly, the drive shaft 64 with the drive roller 60 can be removed and reversed such that the portion with the "O" rings 78 would be on the opposite side of the frame and the tapered portion 62 is still pointing towards the center of the drive shaft 64. As an alternative to the removal of the shaft 64, the drive roller 60 can be released from the shaft 64 by loosening set screw 86, and placing it back on the shaft in a reversed orientation. The paper guides 79 are loosened by the thumb screws 84 and the collar 82 is slid to the opposite side of the frame. The thumb screws 38 are loosened and the bearing supports 34 are pivoted such that the guide bars 36 are pointing towards the reoriented fold plates 40 and 42. Thus, with these few adjustments, the web folding device 10 is easily adapted for feeding the stack from the opposite side of the frame which results in the opposite portion of the web emerging as the top of the folded form.

Thus, it is apparent that there has been provided, in accordance with the invention, a web folding device that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A web folding device for folding an unfolded web longitudinally along a weakened fold line and wherein the web has opposite side edges, the device for use in combination with a web processing machine which draws the web from the web folding device in a downstream path of travel, the device comprising:

a frame;

an upper roller means mounted to the frame and extending horizontally across the path of travel of the unfolded web;

motor driven roller means mounted to the frame below the upper roller means and extending horizontally across the path of travel of the folded web;

a pair of fold plates mounted to the frame and disposed between the upper roller means and motor driven roller means, the fold plates defining a channel through which the web passes and is gradually folded by the fold plates contacting the surface of the web on opposite sides of the fold line;

a driven exit roller mounted to the frame and positioned downstream from the motor driven roller means;

at least one drive belt connecting the motor driven roller means to the driven exit roller, such that both rollers rotate in the same downstream direction;

whereby when the web processing machine is not drawing the web from the device the web is slack and does not tightly engage the drive belt such that the web is not driven in the downstream direction of travel, and when the web processing machine is drawing the web from the device the web is placed in tension and frictionally engages the drive belt such that the belt aids in driving the web in the downstream direction of travel.

2. The web feeding device of claim 1 wherein the motor driven roller means has at least two different diameter portions the greater diameter portion of the roller disposed adjacent the weakened fold line and the lesser diameter portion disposed adjacent the edges such that when the web processing machine draws the web the greater diameter portion provides a greater pulling force on the web along the fold line and the lesser diameter portion provides a lesser force along the edges which minimizes the risk of the web tearing.

3. The web feeding device of claim 2 and further comprising guide bar means mounted to the frame and extending between the upper roller means and the pair of fold plates to guide the web from the upper roller means toward the fold plates and direct the weakened fold line toward the channel defined between the fold plates.

4. The web feeding device of claim 3 wherein the axis of the motor driven roller means is positioned at substantially a right angle to a vertical plane extending through the long axis of the upper roller.

5. The web feeding device of claim 3 wherein the motor driven roller means is continuously driven by a motor at a speed which causes the drive belt to maintain a linear velocity greater than the velocity which the web processing machine draws the web from the device.

6. The web feeding device of claim 1 wherein a plurality of drive belts connect the motor driven roller means to the driven exit roller.

7. The web feeding device of claim 1 wherein the upper roller means is mounted to the frame by means of bearings such that the upper roller means freely rotates.

8. The web feeding device of claim 1 wherein at least one of the fold plates is pivotally mounted to provide for a gradually narrowing of the channel in the downstream direction.

9. The web feeding device of claim 8 and further comprising spring means connected to the pivotally mounted fold plate to cause the downstream portion of the pivotally mounted plate to pivot towards the other fold plate thereby narrowing the channel and maintaining the downstream portion of the pivotal fold plate in contact with the web.

10. The web feeding device of claim 1 and further comprising adjustable guides mounted to the frame upstream of the upper roller means to initially position the web in the device such that the fold line is in vertical alignment with the channel defined between the fold plates.

11. The device of claim 1 wherein the web is divided by the fold line into left and right portions, the device folding the web so either the left portion or right portion can selectively be folded by selective means to emerge from the device on top of the other portion.

12. The device of claim 11 wherein the selective means comprise moving the motor driven roller means, fold plates, drive belt, and unfolded web to an opposite side of the device, such that the web is fed into the device from the opposite side and results in the right portion emerging on top of the left portion.

* * * * *